US006340861B1

(12) United States Patent
Jakab et al.

(10) Patent No.: US 6,340,861 B1
(45) Date of Patent: Jan. 22, 2002

(54) HALOGEN INCANDESCENT LAMP WITH CLAMPING SADDLES

(75) Inventors: Csaba Jakab, Szt. Donét u. 49; László Kohán, Albert u. 23, both of (HU); Ronald Francis Scott, Paris, KY (US); Jerome John Schneider, Jr., Chagrin Falls, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/406,447

(22) Filed: Sep. 27, 1999

(51) Int. Cl.[7] ..... H01J 5/56

(52) U.S. Cl. ..... 313/318.07; 313/318.05; 439/607

(58) Field of Search ..... 313/113, 315, 313/318.07, 318.05, 318.02, 318.12, 579; 439/617, 602

(56) References Cited

U.S. PATENT DOCUMENTS 4,310,772 A 1/1982 Tyler et al. ..... 313/113
4,316,240 A * 2/1982 Pitkjaan et al. ..... 313/113
4,342,142 A 8/1982 Nieda et al. ..... 29/25.13
4,429,249 A 1/1984 Tyler et al. ..... 313/113
4,451,873 A * 5/1984 Tyler et al. ..... 313/113
4,473,770 A * 9/1984 Baba et al. ..... 313/315

* cited by examiner

*Primary Examiner*—Michael H. Day

(57) ABSTRACT

A halogen incandescent lamp is provided. The lamp has at least one incandescent coil and an envelope including a pinched portion from which electrodes project. Clamping saddles made of bent metal strips are mounted on the pinched portion. Each clamping saddle has a wing extending in a plane placed across the central axis of the lamp, and each electrode is electrically connected to a clamping saddle. The lamp includes lead wires cut to shape from metal strips of appropriate thickness and have an elongated shape in the direction of the central axis of the lamp. Each lead wire is mechanically and electrically connected to a wing of a clamping saddle. One of the lead wires is formed in the plane of the wings without bending, while the other lead wire is bent so that the free end thereof raises from the plane of the wings at a distance corresponding at least to the radius of said envelope.

8 Claims, 1 Drawing Sheet

HALOGEN INCANDESCENT LAMP WITH CLAMPING SADDLES

BACKGROUND OF THE INVENTION

This invention relates to a halogen incandescent lamp suitable primarily for automotive headlight lamps with reflector envelope, and more particularly to a lamp structure suitable for fixing in sealed beam automotive headlight reflectors.

For automotive headlight reflectors, halogen incandescent lamps are usually used that form a closed unit with the reflector envelope preventing moisture or dust from getting in. One end of the reflector envelope is sealed with an optical lens and the other end is sealed with adhesive material placed into the gaps between the electrical lead wires of the lamp and the holes formed in the bottom portion of the reflector envelope. Prior to sealing, the axis of the lamp has to be optically adjusted to the axis of the reflector envelope. The ends of said lead wires are formed to be standard electric contacts as regards their material thickness and distance from each other as well as shape.

U.S. Pat. No. 4,342,142 describes a headlight reflector in which the electric lead wires of the lamp reach to electric blade contacts through holes formed in a plastic base. The lead wires are soldered to the electric blade contacts. A disadvantage of this solution is the troublesome manufacturing process which is less suitable for automation since the standard blade contacts and the lead wires of the lamp do not form a single part.

Unification of the lead wires of the lamp and the standard blade contacts is described e.g. by U.S. Pat. No. 4,310,772 where the same parts serve as lead wires and standard contacts. This solution simplifies the manufacturing process also by the method of fixing of the lamp envelope which is also accomplished by these parts. Tabs formed from the electric lead wire mechanically fix the lead wires on the pinch sealed portion of the envelope of the lamp. At the same time, a socket disc for the optical adjustment of the incandescent coil of the lamp appears as an additional part.

A solution very similar to the previous one is described in U.S. Pat. No. 4,429,249. This solution requires no separate part for the optical adjustment of the incandescent coil. This adjustment is accomplished directly by fixing the electric lead wires loosely fitted in the holes formed in the bottom portion of the reflector envelope with an adhesive material in an appropriate position. The electric lead wires end in standard connectors which, being knife-shaped contacts, have a flat surface and the planes of their flat surfaces are perpendicular to the pinched portion of the envelope of the lamp. However, this construction is not suitable for connectors where the planes of the knife-shaped contacts are parallel to the pinched portion of the lamp. This construction is also not suitable when one of the connectors raises from the plane placed through the central axis of the lamp at a distance corresponding at least to the radius of the lamp.

Having standard connector contacts and electric lead wires forming one part therewith, H4703 type headlight lamps of General Electric Company have been sold. This type of headlight lamps could be ordered on the basis of GE Lighting, Miniature and Sealed Beam Lamp Catalog, 9/97. In these lamps, the electric lead wires are bent wires with tubular cross-section that are flattened at the places of fixing to the reflector envelope and at the places of the connector contact. The purpose of flattened portions at the place of fixing to the reflector envelope and at the place of the connector contact is providing an adhesion of appropriate strength and forming the standard knife-shaped contact, respectively. However, forming the electric lead wires in this way has several disadvantages. On one part, forming the knife-shaped contacts by flattening is disadvantageous since the tolerances specified by the standard are hard to reach using this method; on the other part, leakage may occur at the place of fixing to the reflector envelope if the flattening is not perfect. It is an additional disadvantage that bending the wire of tubular cross-section on a machine is an operation that is hard to control, and this bending has to be performed on both electric lead wires independently of the placing of the connectors.

Thus there is a particular need for a halogen incandescent lamp in which the electric lead wires make up a construction forming one part with the connector contacts and meeting the tolerance requirements of the standard easily. This part comprises no separate components and is easy to bend. It does not require flattening.

BRIEF SUMMARY OF THE INVENTION

A halogen incandescent lamp for automotive headlight reflectors is provided having at least one incandescent coil and an envelope including a pinched portion from which electrodes project. Clamping saddles made of bent metal strips are mounted on the pinched portion. Each clamping saddle has a wing extending in a plane placed across the central axis of the lamp, and each electrode is electrically connected to a clamping saddle. The lamp comprises lead wires that are cut to shape from metal strips of appropriate thickness and have an elongated shape in the direction of the central axis of the lamp. Each lead wire is mechanically and electrically connected to a wing of a clamping saddle.

This invention has several advantages. The primary advantage is that the connector contacts with a tolerance specified by the standard are easy to manufacture since the starting material is a rolled sheet with tight tolerances and the pressing operation which is more difficult to control in the process is left out. By cutting out from a sheet, any shape can be formed which enables that a connector contact and an electric lead wire are made as one piece. This eliminates the problems that arise when soldering several parts together. Finally it is also a significant advantage that in case of need bending is performed significantly easier and more accurately on a sheet part than on lead wires with circular or tubular cross-section. It is not necessary to perform bending on the electric lead wires in the event of some connector contacts conforming to the standard, while it is necessary to make bending on lead wires with circular or tubular cross-section in every case. In this way, standard connector contacts are made where the planes of said knife-shaped connectors are parallel to the pinched portion of the envelope of the lamp.

BRIEF DESCRIPTION OF THE DRAWINGS

The most preferred embodiment of the halogen incandescent lamp is illustrated by means of figures where.

DETAILED DESCRIPTION OF THE INVENTION

Figure 1:
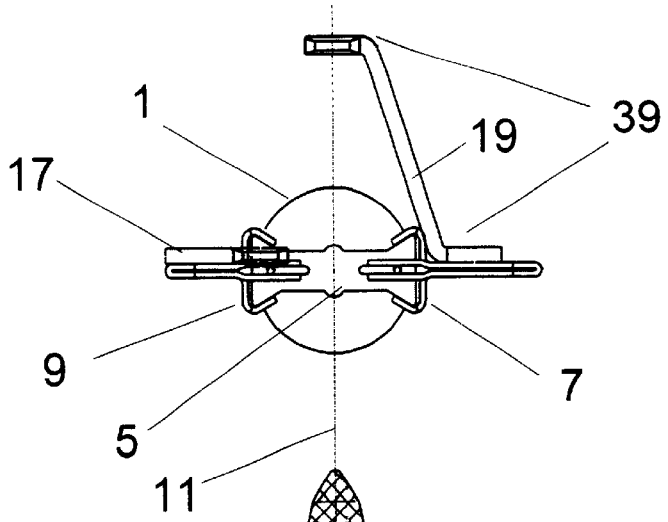
FIG. 1 shows a bottom view of the most preferred embodiment of the halogen incandescent lamp.
Figure 2:
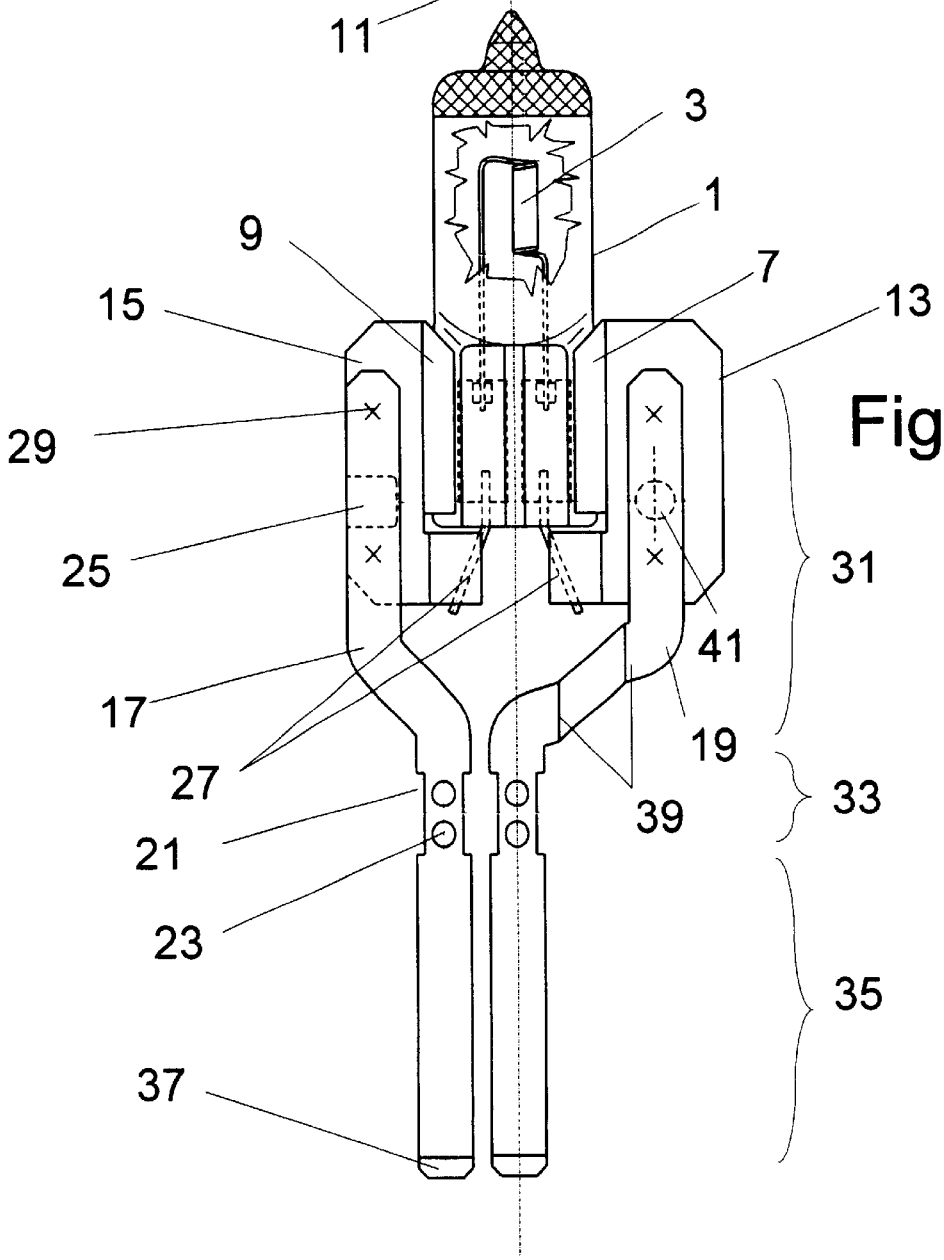
FIG. 2 shows a front view of said embodiment.

The halogen incandescent lamp seen in FIGS. 1 and 2 comprises an envelope 1, an incandescent coil 3, electrodes 27 that are in electrical connection with the incandescent coil 3, clamping saddles 7, 9 that are in electrical connection with the electrodes 27 and in mechanical connection with the pinched portion 5 of the envelope 1, as well as lead wires 17, 19 connected to each of the said clamping saddles 7, 9 with welds 29. The envelop 1 with the incandescent coil 3 and electrodes 27 form a usual halogen incandescent lamp where one end of the envelope is sealed with pinching in known way. The resilient tabs of the clamping sales 7, 9 made of a metal strip clamp the edges of the pinched portion mentioned above while the wings 13, 15 of the clamping saddles 7, 9 are connected to the electrodes 27. Of the two lead wires 17, 19 fixed to the clamping saddles 7, 9 by welds 29, one lead wire 17 is in the plane of the wings 13, 15 of the clamping saddles 7, 9. This means that the lead wire 17 is practically in the plane of the wings 13, 15, it emerges from the plane at an extent of the sheet thickness. The other lead wire projects from the plane placed across the central axis 11 of the lamp at an extent corresponding at least to the radius of the lamp envelope 1, due to the two bends 39 formed. Both lead wires 17, 19 consist of a lead-in part 31, fixing part 33 and a contact part 35. The lead-in part 31 provides for the electrical connection to the electrodes 27, the fixing part 33 is for fixing the assembled lamp to the reflector envelope, and the contact part ensures standard contact to the socket. All the three parts are made of the same metal strip using a cutout and bending process. In the present embodiment, each lead-in part is connected to the wings 13, 15 of the clamping saddles 7, 9 with two welds 29. It is advantageous if positioning elements are made in the clamping saddles 7, 9 in the form of a notch 25 or a bore 41 where the bore and the notch is formed in one clamping saddle 7 and in the other clamping saddle 9, respectively. The wings 13, 15 extend to distances different from each other from the central axis 11 of the lamp in the plane placed across the central axis 11 of the lamp. In the fixing parts 33, notches 21 as well as dimples 23 are formed for a better mechanical joint to the reflector envelope. The ends of the contact parts 35 are provided with chamfers 37 for the ease of mechanical connection.

In another embodiment of the lamp described above, the two lead wires 17, 19 are in the same plane, that is none of the lead wires 17, 19 has bends 39.

The lamp and the reflector envelope are connected to each other as follows. The assembled lamp is placed in the reflector envelope so that the lead wires 17 and 19 of the lamp are threaded through the holes formed in the bottom portion of the reflector envelope. During threading, the fixing parts 33 of the lead wires 17, 19 get in the height of the hole formed in the bottom portion of the reflector envelope. This is followed by the optical adjustment in which the relative position of the lamp and the reflector, i.e. the appropriate beam direction is determined. In this position, an adhesive material setting by ultraviolet radiation is placed in said holes, which material fixes the lamp in the reflector envelope after irradiation. It increases the bond strength that notches 21 and dimples 23 are formed in the fixing parts 33 of the lead wires 17, 19.

What is claimed is:

1. A halogen incandescent lamp for automotive headlight reflectors, said lamp comprising at least one incandescent coil, an envelope including a pinched portion, electrodes projecting from said pinched portion, clamping saddles made of bent metal strips and being mounted on said pinched portion, each clamping saddle having a wing extending in a plane placed across the central axis of the lamp, said electrodes each being electrically connected to a clamping saddle, lead wires being cut to shape from metal strips of appropriate thickness and having an elongated shape in the direction of the central axis of the lamp, each being mechanically and electrically connected to said wing of said clamping saddle, one of the lead wires being formed in the plane of said wings without bending, while the other lead wire being bent so that the free end thereof raises from the plane of said wings at a distance corresponding at least to the radius of said envelope.

2. The lamp of claim 1 in which the lead wires made of metal strips have at least one notch for the anchoring thereof to said reflectors with adhesive material.

3. The lamp of claim 1 in which the lead wires made of metal strips have at least one dimple for the anchoring thereof to said reflectors with adhesive material.

4. The lamp of claim 1 in which said wings of said clamping saddles extend to different widths in the plane placed across the central axis of the lamp.

5. The lamp of claim 1 in which the lead wires are welded to said wings of said clamping saddles at least on one spot.

6. The lamp of claim 1 in which said wings of said clamping saddles have at least one positioning element thereon.

7. The lamp of claim 6 in which said positioning element is a through bore on said wing of one clamping saddle and a notch is formed at the edge of said wing of the other clamping saddle.

8. A halogen incandescent lamp for automotive headlight reflectors said lamp comprising at least one incandescent coil, an envelope including a pinched portion, electrodes projecting from said pinched portion, clamping saddles made of bent metal strips and being mounted on said pinched portion, each clamping saddle having a wing extending in a plane placed across the central axis of the lamp, said electrodes each being electrically connected to a clamping saddle, lead wires being cut to shape from metal strips of appropriate thickness and having an elongated shape in the direction of the central axis of the lamp, each being mechanically and electrically connected to said wing of said clamping saddle, both lead wires being formed in the plane of said wings without bending.

* * * * *